United States Patent [19]

Knight

[11] Patent Number: 4,460,039

[45] Date of Patent: Jul. 17, 1984

[54] WELLHEAD VALVE REMOVAL AND INSTALLATION TOOL

[75] Inventor: John W. Knight, Shreveport, La.

[73] Assignee: W-K-M Wellhead Systems, Inc., Shreveport, La.

[21] Appl. No.: 439,082

[22] Filed: Nov. 4, 1982

[51] Int. Cl.[3] ..... E21B 19/16

[52] U.S. Cl. ..... 166/80; 166/77; 166/85; 166/379; 254/29 R; 254/106

[58] Field of Search ..... 166/85, 77, 77.5, 80, 166/82, 84, 86, 377, 379, 383, 386, 387; 254/29 R, 106, 30

[56] References Cited

U.S. PATENT DOCUMENTS

| | | | |
|---|---|---|---|
| 2,241,288 | 5/1941 | Yancey | 166/85 |
| 2,250,244 | 7/1941 | Yancey | 29/157.1 R |
| 2,358,677 | 9/1944 | Yancey | 166/85 |
| 2,517,870 | 8/1950 | Gump | 166/85 |
| 2,555,145 | 5/1951 | McKinney | 166/77 |
| 3,830,304 | 8/1974 | Cummins | 166/85 |
| 3,895,778 | 7/1975 | Ahlgren | 254/106 |
| 4,127,167 | 11/1978 | Arendt | 166/85 |
| 4,184,504 | 1/1980 | Carmichal et al. | 137/15 |

FOREIGN PATENT DOCUMENTS

| | | | |
|---|---|---|---|
| 2500859 | 2/1976 | Fed. Rep. of Germany | 254/106 |

*Primary Examiner*—William F. Pate, III
*Assistant Examiner*—Hoang C. Dang
*Attorney, Agent, or Firm*—Marvin J. Marnock

[57] ABSTRACT

A tool (10) for the installation and removal of back pressure valves or plugs in a wellhead under pressure conditions to permit repair and replacement of wellhead outlet valves. The tool (10) comprises an elongate cylindrical housing (31, 32, 33) in which a manipulator rod (30) is slidably mounted in axial alignment therewith. The tool (10) includes a piston (55) which is sleeved about the rod (30) and adapted to be selectively clamped thereto. The manipulator rod (30) is provided at one end with a back pressure valve of plug (84) attached thereto. The tool (10) includes a fluid controls system which is connectable to an external fluid pressure source (P) or the pressure of the well itself. The fluid controls system with associated valves effects pressure balancing of the rod by well pressure and permits actuation of the piston (55) to effect insertion of the manipulator rod (30) into the well against the wellhead pressure in a series of steps utilizing fluid pressure from the external source (P) or from the well itself to drive the piston (55). The manipulator rod (30) is inserted by clamping the piston (55) to the rod (30) during the down strokes until the back pressure valve or plug (84) engages a threaded portion of the bore of the wellhead. By axial rotation of the manipulator rod (30), the back pressure valve or plug (84) is threadedly connected into the wellhead bore to shut off the well and permit the removal and replacement of wellhead valves. The manipulator rod (30) may then be removed from the wellhead by manually gripping and lifting the rod after its detachment from the plug (84), the tool housing and piston (55) or by a series of steps utilizing the pressure source (P) to repeatedly actuate the piston with selective clamping of the piston to the rod (30) during the up strokes to push the rod (30) out of the wellhead.

9 Claims, 5 Drawing Figures

WELLHEAD VALVE REMOVAL AND INSTALLATION TOOL

BACKGROUND OF THE INVENTION

This invention is related to tools used for installing and removing back pressure valves from a fluid conduit system that must remain pressurized and is particularly designed for use on wellhead assemblies to permit the removal and replacement of wellhead outlet valves under pressure conditions.

One device which is known in the prior art for removing wing valves and the like from a wellhead assembly is shown in U.S. Pat. No. 2,250,244 to J. R. Yancey. This device utilizes a threaded plug which is inserted through the valve by a suitable manipulator apparatus to seal off fluid flow into the valve. The apparatus is designed such that the pressurized fluid acting on the inner face of the plug flows through the interior of the apparatus to the rear of the plug thereby equalizing pressure on both ends of the plug. Nevertheless, compressed packings about the manipulator necessitates the application of considerable torque to a threaded manipulator rod to drive the plug carrier and plug into operative position in the well bore. The length of the threaded rod requires that a relatively long time is needed to insert or remove a plug from the well bore. Further, since the threads between the rod and plug carrier are exposed to the well fluids, they are susceptible to jamming by presence of sand in the well fluids.

Another type of tool which is used for the removal of valves from a pressurized wellhead assembly is disclosed in U.S. Pat. No. 4,184,504 to Carmichael et al. The tool which is mountable on the fluid coupling of a valve includes an extendable manipulator with an expandable packing assembly carried thereon for insertion through the valve into the wellhead. The manipulator is used to expand the packing assembly to block fluid flow through the well conduit and includes a releaseable latch which is controllable by the manipulator for securing the package assembly in the wellhead. The manipulator includes a piston and cylinder arrangement for extending the manipulator through the valve and requires an external fluid pressure source, such as a pump, for driving the piston and overcoming fluid resistance in the valve.

An object of this invention is to provide a tool for the installation of a back pressure valve in an operating wellhead under pressure conditions which utilizes the pressure of the well for operation of the tool.

Another object of the invention is to provide a tool for the installation and removal of a back pressure valve or plug in a pressurized wellhead to permit the removal and replacement of master valves in the wellhead, particularly a lower master valve, in a safe, reliable, and efficient manner and in less time than has heretofore been possible.

A further object is to provide a tool for the installation and removal of a back pressure valve in a pressurized oil or gas wellhead wherein the tool comprises a piston and cylinder arrangement which is selectively powerable by the fluid pressure of the well or an alternate external source of fluid pressure to effect the insertion of the back pressure valve into the bore of the wellhead against the well pressure in a timely and efficient manner.

SUMMARY OF THE INVENTION

The invention is a tool for the installation and removal of back pressure valves in a wellhead under pressure conditions to permit repair and replacement of wellhead outlet valves. The tool comprises an elongate cylindrical housing in which a manipulator rod is slidably mounted in axial alignment therewith. The tool includes a piston which is sleeved about the rod and adapted to be selectively clamped thereto. The manipulator rod is provided at one end with a back pressure valve attached thereto. The tool includes a hydraulic system which is connectable to an external fluid pressure source or the pressure of the well itself. The hydraulic system with associated valves permits actuation of the piston to effect insertion of the manipulator rod into the well against the wellhead pressure in a series of steps utilizing the fluid pressure from an external source or from the well itself to drive the piston. The manipulator rod is inserted by clamping the piston to the rod during the down strokes and the insertion continued to where the back pressure valve engages a threaded portion of the bore of the wellhead. By rotation of the manipulator rod, the back pressure valve can be threadedly connected into the wellhead bore to shut off the well and permit the removal and replacement of wellhead valves. The manipulator rod may then be removed from the wellhead by a series of steps utilizing the fluid pressure to repeatedly actuate the piston and selective clamping of the piston to the rod during the up strokes to push the rod out of the wellhead.

DESCRIPTION OF A PREFERRED EMBODIMENT

Figure 1:
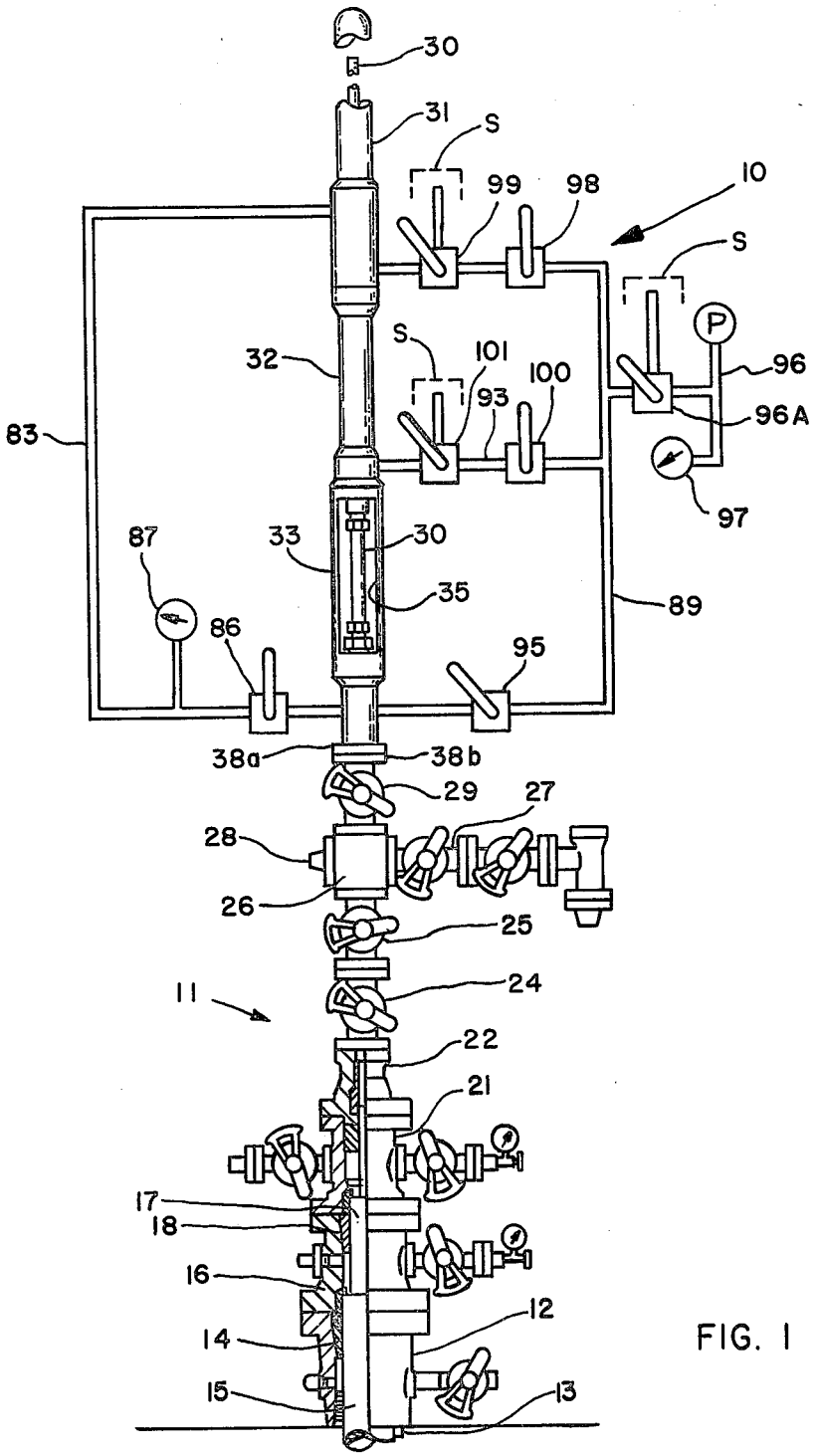
FIG. 1 is a elevation view of a wellhead assembly and the upper portion of a well casing wherein the tool of this invention is shown mounted atop a swab valve of the assembly and portions of the assembly are shown in section for purposes of clarity.

Referring more particularly to FIG. 1 of the drawings, the tool 10 of this invention is shown mounted on a typical wellhead assembly. The wellhead assembly includes a casing head 12 which is mounted atop the outer casing 13 of the well and carries casing slips 14 therein from which is suspended an intermediate casing string 15. Surmounted on the casing head 12 is a casing head spool 16 which supports an inner casing string 17 by means of a casing hanger 18. The casing head 12 and casing head spool 16 are mounted in the assembly with their central bores and the casing strings 13, 15, 17 arranged in coaxial alignment. In addition to the casing heads 12 and 16, the well assembly includes a tubing head spool 21 which is mounted coaxially atop the casing head spool 16 and a hanger spool 22 mounted atop the tubing head spool 21. The hanger spool 22 is equipped with a conventional tubing hanger for supporting the string of production tubing and the tubing head spool includes a wrap around bushing for sealing the annulus around the tubing string.

Flow from the production tubing is controlled by a pair of master valves 24, 25 which are connected in series and mounted atop the hanger spool 22. The lower master valve 24 which connects directly to the hanger spool 22 is normally maintained in the full open position and is used to shutoff the well or control the flow in the event the upper master valve 25 malfunctions.

The master valve 25 controls production flow to a cross 26 located directly atop the master valve 25 and from which a flowline 27 connects laterally therewith. In lieu of a second flowline connection, a bull plug 28 closes off the other lateral port of the cross 26. Mounted atop the cross 26 is a swab valve 29 which in operation opens or closes off the top port of the cross 26.

The tool of this invention is intended for use when it becomes necessary to repair or replace one of the master valves 24, 25 of the wellhead assembly. In such event, it is desirable to shut off the well in the wellhead at a location below the lower master valve 24. For this purpose, it is customary to install a back pressure valve in the hanger spool 22 to serve as a plug for the wellhead bore. In FIG. 1, the tool 10 of this invention, which is particularly adapted for the expedient installation and removal of such a back pressure valve in high pressure wells, is shown mounted atop the well assembly 11 from which the tree cap has been removed.

The tool 10 comprises an elongated housing in which an elongate manipulator rod 30 is axially received and adopted for reciprocal axial motion therein. The manipulator rod 30 extends through the lower end of the housing and is adapted to be fitted at its lower end with a back pressure valve for installation in the wellhead bore. The housing with reference to its orientation with respect to the wellhead, includes an upper housing portion 31, a central housing portion 32, a lower housing portion 33, and an adapter 34. The housing portions including adapter 34 are of generally cylindrical configuration and circular cross-section with their central bores 31*a*, 32*a*, respectively, disposed in axial alignment. The upper housing 31 is provided with external threads at its lower end for cooperative engagement with internal threads in the upper end of the central housing 32 to form a threaded connection therewith. Similarly, the lower end of the central housing 32 is provided with external threads for cooperative engagement with internal threads in the upper end of the lower housing 33 to which it is threadedly connected. The lower housing 33 is provided with long slotted openings 35 through the wall thereof and extending throughout most of its length for purposes herewith described.

The adapter 34 is affixed to the lower end of the lower housing 33 for facilitating mounting of the tool 10 in operative position atop the wellhead. The upper end of the adapter is threadedly connected into the internally threaded bore of the lower end of the lower housing 33 and is provided with a radial flange 38*a* for coupling to a corresponding flange 38*b* of the wellhead by bolting or the like. The adapter 37 is formed with a central axial bore through which the rod 30 extends.

The central axial bore of the adapter 34 includes an intermediate portion 36 which is of only slightly larger diameter than that of the rod 30 so as to permit its sliding movement therethrough. The upper end of its axial bore is an enlarged diameter counterbore portion 37 which terminates at a radial annular shoulder 38 and is provided with a smooth bore wall portion 39*a* adjacent the annular shoulder 38 and an internally threaded portion 39*b* at its outer end for receiving a packing gland 40 which is threaded therein.

Figure 3:
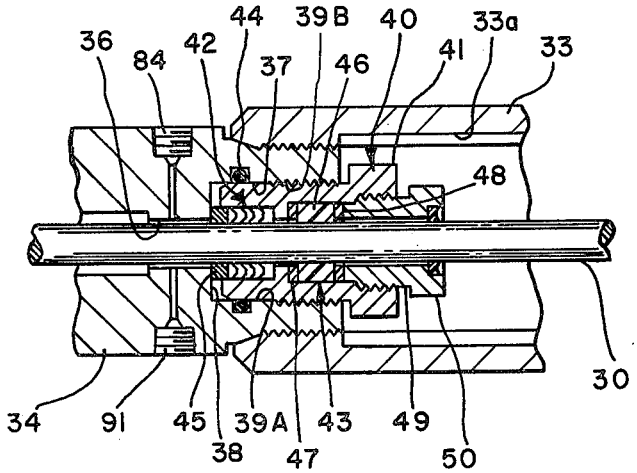
FIG. 3 is an enlarged fragmentary sectional view of a lower packing gland which can be selectively activated to clamp and seal against the manipulator rod of the tool of this invention.

The packing gland 40, as best shown in FIG. 3, includes a cylindrical gland housing 41 with a central axial bore which is counterbored from both ends to provide packing chambers for accommodating packing assemblies 42, 43 adapted to sealingly engage and clamp the manipulator rod 30 when the packing gland 40 is energized. The packing assembly 42 in the lower packing chamber abuts against the annular shoulder 38 in the axial bore through the adapter 34. The shoulder 38 serves as a packing stop and retainer for the packing elements which are typically elastomeric packing rings of V-shape radial cross section and arranged in stacked nested relationship with annular back-up members at the ends of the stack of similar elastomeric materials. A retainer ring 45 of a more rigid material such as steel, for example, is placed at the lower end of the stack and abuts the shoulder 38. The smooth wall 39*a* of the packaging chamber bore is provided with an annular groove which accommodates an O-ring 44 for establishing a fluid-tight seal between the gland housing member 41 and the bore wall of the adapter 34.

The packing assembly 43 in the outer packing chamber of the gland housing 41 includes an annular rubber bushing 46 with close-fit anti-extrusion rings 47, 48 on opposite sides thereof. The two packing assemblies are energized by a packing adapter element 49 which is threaded into the bore at the outer end of the gland housing 41 to compress and radially expand the packing assemblies 42, 43 into sealing engagement with the cylindrical walls of the packing chambers and into sealing clamping engagement with the surface of the manipulator rod 30. The outer end of the packing adapter element 49 is formed with an enlarged head 50, such as a hexagon head whereby it may be turned in one direction by a suitable tool inserted through one of the slots 35 in the lower housing 33 to thereby energize the packing assemblies 42, 43 and clamp the rod 30. Alternatively, it may be turned in reverse rotation to deenergize the packing assemblies and permit the manipulator rod to be moved therethrough.

Figure 2:
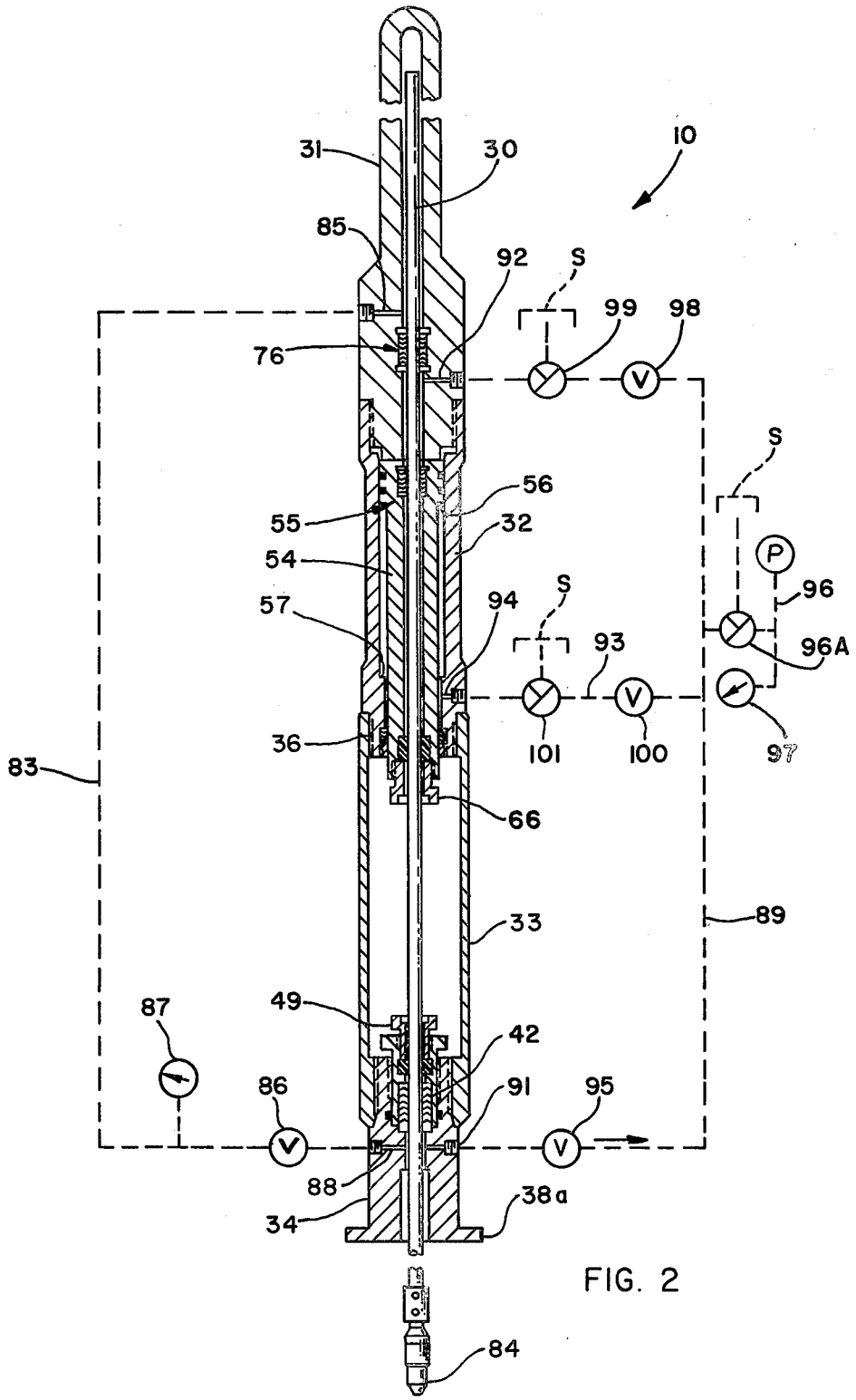
FIG. 2 is a shortened cutaway elevation view of a preferred embodiment of the tool of this invention.

The tool 10 includes a tubular piston member 55 which is sleeved about the manipulator rod 30 and received in the bore of the central housing portion 32 which comprises the cylinder of a piston and cylinder arrangement. As shown in FIG. 2, the piston 55 at its outer end portion corresponds substantially in diameter to that of the bore 32*a* of the central housing 32 so as to provide a close fit therewith and to be slidably received therein. The piston includes an elongate portion 54 of reduced external diameter which extends through the connection of the tool housing portions 32 and 33 so that its lower end is disposed within the housing 33. An annular shoulder 56 formed at the underside of the enlarged upper end of the piston serves as a piston stop which is adapted to engage an annular shoulder 57 formed in the bore of the central housing 32 adjacent the end of the housing 32 which connects with the lower housing 33. It will thus be seen an annulus 53 is formed between the exterior of the lower end portion 54 of piston 55 and the internal wall of the axial bore through the housing section 32. The piston 55 is adapted to be moved in either direction through the housing 32 by means of a fluid pressurized system to be hereinafter described. In FIG. 2, the piston is shown in an uppermost position wherein the upper end of the piston abuts the lower end of the upper housing 31. It is also adapted to be moved to a lowermost position wherein the piston shoulder 56 abuts the shoulder stop 57.

Figure 4:
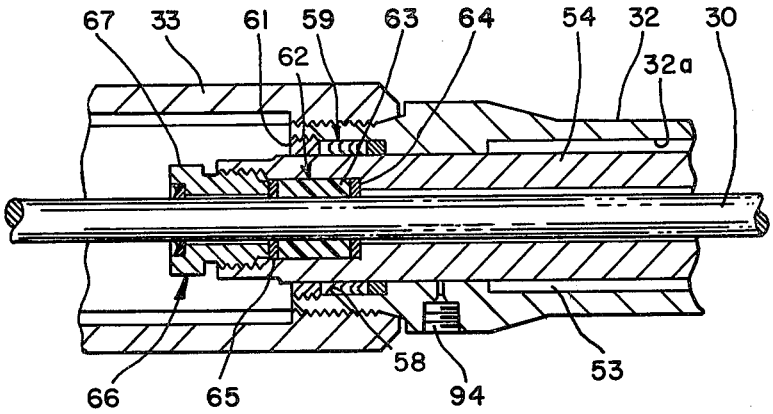
FIG. 4 is an enlarged fragmentary sectional view of another packing gland which is affixed to the lower end of the piston of this invention and can be selectively activated for clamping the piston to the manipulator rod.

As best shown in FIG. 4, the axial bore in the lower end of the housing 32 conforms in a close fit with the external diameter of the lower end 54 of the piston 55 which is slidably received therein. However, the lower end of the housing is counterbored to provide a packing chamber 58 for receiving a packing assembly 59 therein. The packing assembly 59 includes conventional packing elements such as V-shaped elastomeric packing rings with adapter back up rings at either end of the assembly and a steel retainer ring 61 which is threaded into the lower end of the packing chamber to retain and energize the packing rings by compressing the same thereby establishing a fluid-tight seal between the piston 55 and the housing 32.

The piston 55 at its lower end is provided with an enlargement of its axial bore which forms a packing chamber for receiving a packing gland assembly 62 therein. The packing assembly comprises an annular packing element 63 such as a rubber bushing or woven wire packing element with a pair of metal back-up members 64, 65 which serve as anti-extrusion rings. A packing adapter 66 is threadedly connected into the lower end of the piston 55 which is provided with internal threads for cooperating therewith. The packing adapter 66 is formed with an enlarged hexagon shaped head 67 whereby it may be turned by a suitable tool for threading into the piston 55. When fully threaded into the piston 55, the packing adaptor 66 compresses and energizes the packing element 63 into a sealing and clamping relationship with the manipulator rod 30. The rod 30, of course, may be released by unthreading and retracting the packing adapter 66 sufficiently to remove the compression of the packing element 63. The hexagon head 67 of the packing gland adapter 66 is accessible through the slots 35 in the lower tool housing 33.

Figure 5:
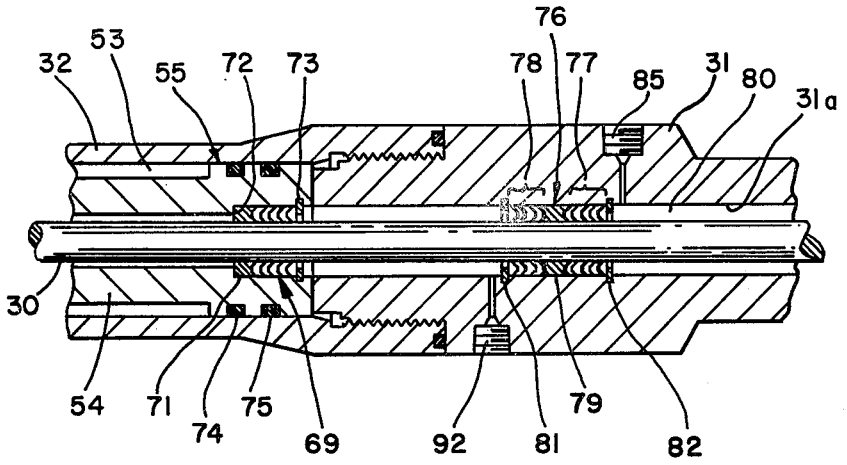
FIG. 5 is an enlarged fragmentary sectional view of the connection of the upper and lower housings of the tool of this invention with the piston at its uppermost position in the tool housing and showing details of the packing assemblies for sealing against the tool manipulator rod.

As shown in FIG. 5, the upper end of the bore through the piston 55 is also formed with an enlarged diameter and accommodates a packing assembly 69. The packing assembly comprises a plurality of packing rings, preferably of elastomeric material, and a lower back-up ring 71 which is preferably of a harder more rigid material such as steel. The back-up ring 71 abuts the annular shoulder or stop 72 provided by the enlargement of the bore through the piston 55 and a snap ring 73 which is inserted in an accommodating annular groove in the enlarged bore through the piston serves as a packing retainer at the other end of the packing assembly. A pair of O-rings 74, 75 are also installed in external grooves provided about the enlarged upper end of the piston 55 to seal between the piston and the bore of the central housing 32.

A bi-directional packing assembly 76 is also provided in the lower end of the axial bore 31*a* of the upper tool housing 31 near its connection with the central housing member 32. As best seen in FIG. 5, the axial bore 31*a* is of larger diameter than the rod 30 so that an annulus 80 is formed therebetween. The packing assembly 76 comprises an upper group 77 of annular packing elements separated from a lower group 78 of packing elements by a spacer ring 79. A snap ring 81 received in an accommodating annular groove in the bore wall of the housing serves as a bottom retainer for the packing assembly 76. A similar snap ring 82 also installed in an accommodating groove in the bore of the upper housing 31 serves as the upper retainer for the packing assembly. The packing rings in both the upper and lower groups of packing elements are elastomeric rings of conventional V-shape in radial configuration. The packaging rings are compressed by installation of the snap ring retainers and in the lower group 79, are stacked with their concave surfaces facing the well pressure. The upper group 78 of packing elements are faced in the opposite direction to seal against pressurized fluid against the top side of the snap ring 82 which is directed thereto from the wellhead bore by means of a hydraulic control system shown schematically in FIGS. 1 and 2 and herein later described.

When it is desired to remove or replace the lower master valve 24 of the wellhead, it is necessary that a plug conventionally in the form of a back pressure valve be installed in the wellhead bore at a location below the master valve 24. For this purpose, a back pressure valve 84 is affixed to the lower end of the manipulator rod 30 as by a threaded connection or other releaseable connection means. The back pressure valve 84 is typically provided with external threads for connecting into a threaded socket provided in the bore of the hanger spool 22. For installation of the plug, it is necessary that the swab valve 29, the upper master valve 25 and the lower master valve 24 be opened so that the manipulator rod 30 with its attached back pressure valve may be passed therethrough. The external threads of the back pressure valve may be left-hand threads so that rotating the rod 30 in a counterclockwise direction about its axis will fix the back pressure valve in the hanger spool socket. Also, the connection of rod 30 to the back pressure valve is by right-hand threads (not shown) so that continuing the counterclockwise rotation of the rod 30 will cause the rod to back off from the back pressure valve and leave it in place.

The hydraulic controls system, best shown in FIG. 2, is provided for controlling the actuation of the piston 55 in either direction of axial movement through the tool housing as will be hereinafter described. It is also provided for selectively communicating the well pressure to the top end of the manipulator rod 30, thereby balancing the pressure at both ends of the rod. Pressure balancing of the rod 30 is important for reducing the effort required to force the manipulator rod into the wellhead bore against the pressure of the well. It is also an important safety feature for minimizing the likelihood of violent ejection of the rod.

The hydraulic controls system which is employed for driving the tool piston 55 and accordingly the rod 30, comprises a conduit 83 which connects well pressure outlet port 88 provided through the wall of the adapter 34 with an inlet port 85 provided through the wall of the upper tool housing portion 31. The port 88 in the adapter 34 is formed below the packing 42 and communicates with the axial bore through the adapter 34. Internal threads are provided at the outlet of the port 88 to permit threaded connection with the conduit 83. In like manner, the port 85 communicates with the axial bore through the upper housing 31 at a point above the packing elements 77 and it is internally threaded adjacent its outlet for threaded connection with the conduit 83. A two-way valve 86 is provided in the conduit 83 to selectively control the pressure balancing of the manipulator rod 30. A pressure gauge 87 is also included in the conduit 83 to provide an indication of well pressure.

The hydraulic controls system also includes a conduit 89 which similarly communicates the axial bore of the adapter 34 below the packing 42 with the axial bore of the upper tool housing portion 31 at a location above the packaging assembly 69 but below the packing elements 77, 79. Lateral ports 91, 92 with threaded outlets are provided in the adapter 34 and upper housing portions 31 respectively for connection with the conduit 89. The port 92 is an inlet for introduction of fluid pressure for driving the piston 55 downwardly into the well bore.

A branch conduit 93 also connects the conduit 89 with the central tool housing portion 32 and is provided for establishing fluid communication between the wellhead bore and the central bore of the housing portion 32 in the annulus defined by the exterior of the piston 55 and the inner bore wall of the housing portion 32. The conduit 93 communicates with the annulus 53 surrounding the piston 55 through a lateral port 94 formed through the wall of the housing portion 32 near the lower end thereof but above the location of the packing assembly 59. The port 94 is a pressure inlet for reverse piston actuation, that is, fluid pressure can be introduced through the inlet 94 to move the piston upwardly and outwardly with respect to the well bore. The port 94 is formed with internal threads adjacent its outlet to permit threaded connection with the conduit 93.

A two-way valve 95 is provided in the conduit 89 intermediate the conduit connection with the adapter 34 and the connection with the branch conduit 93 and serves as an "On-Off" valve for selectively communicating the well pressure to the conduits leading to the ports 92, 94. The valve 95 would also be closed if it is desired to use an external source of fluid pressure, rather than the well pressure itself, for actuating the piston 55. Such a source P, which may be a pump or the like, is shown in FIG. 2 connected to the conduit 89 by means of a conduit 96. A gauge 97 communicating with the conduit 96 is provided for indicating the external source pressure. A three-way valve 96*a* is installed in the conduit 96 for opening or closing the conduit or venting conduit 89 to a sump S.

The communication of fluid pressure to the port 92 is controlled by a pair of valves 98, 99 installed in series in the portion of the conduit 89 between the connections of conduit 89 with the branch conduit 93 and the upper housing portion 31. The valve 98 is a two-way valve and the valve 99 is a three-way valve installed between the valve 96 and the pressure inlet port 92. By operation of the valves 96, 97 to be hereinafter described, fluid pressure may be selectively applied or removed from the top side of the piston 55.

The communication of fluid pressure to the port 94 is selectively controlled by a pair of valves 100, 101 installed in series in the branch conduit 93. The valve 100 is a two-way valve and the valve 101 is a three-way valve installed between the valve 100 and the inlet port 94. By selective operation of the valves 100 and 101, fluid pressure can be selectively applied or removed from the annulus 53 which surrounds the piston 55.

The tool of this invention permits the installation of the back pressure valve in the wellhead bore by use of the well pressure itself, or by an external fluid pressure source. While either source of pressure is suitable, for purposes of explanation, the procedures for operating the tool will be described wherein the pressure of the well itself is used for tool operation. In such instance, the valve 96*a* is placed in the closed position.

Once the tool is mounted on the wellhead as shown in FIG. 1, the procedural steps for operating the tool are as follows:

(a) Valve 95 is closed and valve 86 in conduit 83 is placed in the open condition so that the well pressure is transmitted from the bore 36 in the adapter to the axial bore in the upper housing portion 31, thereby equalizing the pressure on both ends of the manipulator rod 30.

(b) The packing adapter 66, which is accessible through the slots 35 in the lower housing 33, is turned to tighten the packing assembly such that the rod 30 is tightly clamped by the packing 63.

(c) Packing adapter 49 is then turned to insure that the packing gland in the adapter 34 loosens its grip on the rod 30.

(d) Valve 100 is closed and three-way valve 101 is moved to the vent position whereby any fluid pressure in the annulus is relieved to the sump S in the case of hydraulic fluids or to the atmosphere if the system is pneumatic.

(e) Valve 98 is placed in open position and valve 99 is placed in position to transmit the well pressure in the conduit 89 to the inlet port 92.

(f) Valve 95 is opened thereby applying the well pressure to the top end of the piston 55 and driving the piston downwardly until the piston shoulder 56 bottoms against the internal stop 57 in the central housing portion 32. The manipulator rod 30 is thereby carried downward into the wellhead bore by the piston 55 through a distance corresponding to the length of the piston stroke.

(g) Since the back pressure valve 84 must be moved downwardly to engage the threaded socket in the hanger spool 22, the distance it is to be moved equals several lengths of the piston stroke. Accordingly, the piston 55 to be prepared for another downward stroke must be reversely actuated to where it is moved to its original position with its upper end engaging the lower end of the upper housing 31. Packing adapter 49 is therefore turned to compress the packing assembly elements in the adapter 34 into clamping engagement with the rod 30. Packing adapter 66 is then turned to loosen the packing 63 on the rod 30 so that piston 55 releases its grip on the rod 30.

(h) Valve 98 is closed and valve 99 is moved to its vent position which relieves the fluid pressure acting at the top of piston 55. In the case of hydraulic pressure the liquid is vented to the sump S or to the atmosphere, if the working fluid is a gas.

(i) Three-way valve 101 is then moved to the position to pass fluid through the conduit 93 and valve 100 is opened. Accordingly, when valve 95 is opened, well pressure is introduced into the central housing 32 in the annulus surrounding piston 55 to act against the piston shoulder 56 and drive the piston upwardly to the position shown in FIG. 2. The piston 55 is therefore in position for another downward stroke, as described above. Procedural steps (b) through (f) are then repeated to actuate the piston 55 and rod 30 in the downward direction by the distance corresponding to the length of the piston stroke.

By repeating the procedures outlined above, it will thus be seen that the manipulator rod 30 can be moved downward into the wellhead bore in a series of steps, each corresponding to the length of a downward stroke of the piston 55. When the back pressure valve 84 engages the threaded socket in the hanger spool 22, the packing adapters 49 and 66 are both loosened. The rod 30 is then rotated, by a wrench or other suitable tool inserted through the slots 35 in the lower housing 33, until the back pressure valve is secured in the hanger spool 22. The well is therefore effectively shut off.

With the back pressure valve installed, it is then appropriate to bleed the residual well pressure in the conduit 83 and the wellhead bore between the back pressure valve 84 and the adapter packing elements 42. This is done by opening the three-way valve 96*a* to the vent position with the valves 95 and 86 maintained open and valves 98 and 100 being closed.

The connection of the back pressure valve 84 with the rod 30 is such that the rod 30 can be rotated to disconnect from its threaded connection with the back pressure valve 84, leaving the back pressure valve 84 in place in the wellhead bore. The rod 30 must then be retracted from the wellhead bore to clear the wellhead and permit removal of the tool. It an external source of pressure is used, the procedural steps outlined above for driving the rod 30 into the wellhead can then be largely reversed and the rod 30 lifted in a series of steps, each corresponding to an upward stroke of the piston 55. In most instances, however, it will be easier and less time consuming to lift the rod 30 by hand. This, of course, can be accomplished by loosening the packing adapters 49 and 66 and then lifting the rod by gripping the same through the access slots 35.

When the rod 30 is fully retracted into the tool housing, the tool 10 is then removed from the wellhead by uncoupling the flanges 38*a* and 38*b*. The open top of the wellhead then permits access to the wellhead bore and the wellhead valves to be repaired or replaced.

It will thus be seen that a new and improved well tool is disclosed herein which is particularly suited for use in procedures for the removal, repair or installation of wellhead outlet valves, particularly a lower master valve. For lower master valve removal, a suitable tool in accordance with the invention would typically use a manipulator rod of approximately sixteen feet in length and a piston stroke of approximately eighteen inches. This would provide for a travel distance for the rod of thirteen feet representing the total of the series of piston strokes required for installation of the back pressure valve. A typical back pressure valve is provided with a normally closed check valve for pressure balancing purposes when going back into the wellhead to remove the back pressure valve. A conventional plug might be used in lieu of a back pressure valve, in geothermal wells, for example, but some other provision for pressure balancing in the wellhead would typically be required. The particular dimensions for the tool as recited herein can, of course, be adjusted to meet particular needs.

A particular advantage of the tool is that its use can represent a considerable time saving as compared to other tools, typically in the order of fifty percent. This is due primarily to its longer stroke and its automatic mode of operation for moving the rod as opposed to manual. Normally, for well pressure in excess of 15,000 psi, a manual method of moving the manipulator rod is impractical if not impossible. The tool provides for using the pressure of the well itself for tool operation but also provides for an alternative external fluid pressure source.

It is also to be understood that the foregoing description of the invention has been presented for purposes of illustration and explanation and is not intended to limit the invention to the precise form disclosed as changes in details of the illustrated construction may be made by those skilled in the art, within the scope of the appended claims, without departing from the spirit of the invention.

What is claimed is:

1. A tool adapted to operatively connect on an operating wellhead assembly for use in the removal or replacement of wellhead outlet valves under high pressure conditions, said tool comprising:

An elongate housing open at one end and having an axial bore extending from said open end substantially throughout the length of said housing, said housing having connecting means adjacent its open end for mounting on a wellhead with the axial bore of said housing in communication and substantially aligned with the bore of the wellhead;

an elongate rod mounted in the bore of said housing and adapted for axial movement therein, said rod being of such length that one end thereof extends from the open end of said housing when positioned in said housing, and adapted at said one end for removably carrying a plug means for installation in the bore of the wellhead;

a cylinder provided in a section of said housing by an enlarged portion of said housing bore;

a tubular piston member slidably mounted in said cylinder in sleeved relationship to said rod and being movable in said cylinder between an uppermost position and a lowermost position, said piston member having a reduced diameter portion at one end thereof which provides an annular chamber in said cylinder about said piston member reduced diameter portion;

a first piston packing means disposed in the bore through said piston at the upper end thereof and encompassing said rod for establishing a fluid-tight seal between said rod and said piston;

a first adjustable packing gland assembly disposed in the bore through said piston at the lower end of the reduced diameter portion thereof, said packing gland assembly including a second piston packing means disposed in encircling relation to said rod and adjustable clamping means for selectively energizing and radially expanding said second piston packing means into clamping engagement with said rod;

a second adjustable packing gland assembly disposed in the bore of said housing adjacent one end thereof, said second adjustable packing gland assembly including lower annular packing means disposed in encircling relation to said rod and a second adjustable clamping means for selectively energizing said lower annular packing means to radially expand said lower annular packing means into clamping engagement with said rod;

a bi-directional packing seal means in the bore of said housing in encircling relationship to said rod and establishing a fluid-tight sealing relationship with said rod, said bi-directional packing means being disposed in said housing bore at a location spaced from the upper end of the piston when the piston is in its uppermost position;

means for selectively communicating fluid pressure in said well bore to the bore of said housing at a location above said bi-directional packing means thereby equalizing the pressure on both ends of said rod when the tool is mounted in a wellhead and the lower end of the rod is exposed to the well pressure;

means for selectively communicating fluid pressure in said well bore to the bore of said housing and the upper end of said piston when said piston is in its uppermost position to thereby drive said piston to its lowermost position and said rod downwardly by a distance corresponding to the piston stroke when said first clamping means clamps the piston to the rod and said second clamping means is in non-clamping condition; and means for selectively communicating fluid pressure in said well bore to said annular chamber to thereby drive the piston to its uppermost position when said second clamping means is in clamping relation to said rod and said first clamping means is in non-clamping condition, said housing having a section thereof which contains said first and second adjustable packing gland assemblies and being provided with openings through which said packing gland assemblies are accessible for adjustment.

2. A tool as described in claim 1 wherein said rod is adapted to be lowered into the wellhead by a series of piston strokes for predetermined location of said plug means, said plug means being installable in said wellhead bore upon axial rotation of said manipulator rod.

3. A tool as described in claim 1 wherein said housing openings are sufficiently large that the manipulator rod may be manually gripped for axial rotation to install or remove said plug means or may be lifted for removal from the well bore when said first and second clamping means are in non-clamping condition.

4. A tool adapted to operatively connect on an operating wellhead assembly for use in the removal or replacement of wellhead outlet valves under high pressure conditions, said tool comprising:

an elongate housing open at one end and having an axial bore extending from said open end substantially throughout the length of said housing, said housing having connecting means adjacent its open end for mounting on a wellhead with the axial bore of said housing in communication and substantial alignment with the bore of the wellhead;

an elongate manipulator rod mounted in the bore of said housing and adapted for axial movement therein, said rod being of such length as to extend from the open end of said housing when positioned in said housing and adapted at said one end for removably carrying a plug means for installation in the bore of the wellhead;

a cylinder provided in a section of said housing by an enlarged portion of said housing bore;

a tubular piston member slidably mounted in said cylinder in sleeved relationship to said rod and being movable in said cylinder between an uppermost position and a lowermost position, said piston member having a reduced diameter portion at one end thereof which provides an annular chamber in said cylinder about said piston member reduced diameter portion;

a first piston packing means disposed in the bore through said piston at the upper end thereof and encompassing said rod for establishing a fluid-tight seal between said rod and said piston;

a first manually adjustable packing gland assembly disposed in the bore through said piston at the lower end of the reduced diameter portion thereof, said packing gland assembly including a second piston packing means disposed in encircling relation to said rod and adjustable clamping means for selectively energizing and radially expanding said second piston packing means into clamping engagement with said rod;

a second manually adjustable packing gland assembly disposed in the bore of said housing adjacent one end thereof, said second adjustable packing gland assembly including lower annular packing means disposed in encircling relation to said rod and a second adjustable clamping means for selectively energizing said lower annular packing means to radially expand said lower annular packing means into clamping engagement with said rod;

a bi-directional packing seal means in the bore of said housing in encircling relationship to said rod and establishing a fluid-tight sealing relationship with said rod, said bi-directional packing means being disposed in said housing bore at a location spaced from the upper end of the piston when the piston is in its uppermost position;

means for selectively communicating fluid pressure in said well bore to the bore of said housing at a location above said bi-directional packing means thereby equalizing the pressure on both ends of said rod when the tool is mounted in a wellhead and the lower end of the rod is exposed to the well pressure;

an external source of fluid pressure;

means for selectively communicating fluid pressure from said external source of fluid pressure or from said well bore to the bore of said housing and the upper end of said piston when said piston is in its uppermost position to thereby drive said piston to its lowermost position and said rod downwardly by a distance corresponding to the piston stroke when said first clamping means clamps the piston to the rod and said second clamping means is in non-clamping condition; and means for selectively communicating fluid pressure from said external source of fluid pressure or from said well bore to said annular chamber to thereby drive the piston to its uppermost position and said rod remaining stationary when said second clamping means is in clamping relation to said rod and said first clamping means is in non-clamping condition.

5. A tool as described in claim 4 wherein said rod is adapted to be lowered into the wellhead by a series of piston strokes for predetermined location of said plug means, said plug means being installable in said wellhead bore upon axial rotation of said manipulator rod.

6. A tool as described in claim 4 wherein said housing is provided with openings which are sufficiently large that the manipulator rod may be manually gripped for axial rotation to install or remove said plug means or may be lifted for removal from the well bore when said first and second clamping means are in non-clamping condition.

7. A tool adapted to operatively connect on an operating wellhead assembly for use in the removal or replacement of wellhead outlet valves under high pressure conditions, said tool comprising:

an elongate housing open at one end and having an axial bore extending from said open end substantially throughout the length of said housing, said housing having connecting means adjacent its open end for mounting on a wellhead with the axial bore of said housing in communication and substantially aligned with the bore of the wellhead;

an elongate rod mounted in the bore of said housing and adapted for axial movement therein, said rod being of such length that one end thereof extends from the open end of said housing when positioned in said housing and adapted at said one end for removably carrying a plug means for installation in the bore of the wellhead;

a cylinder provided in a section of said housing by an enlarged portion of said housing bore;

a tubular piston member slidably mounted in said cylinder in sleeved relationship to said rod and being movable in said cylinder between an uppermost position and a lowermost position;

a first piston packing means disposed in the bore through said piston and encompassing said rod for establishing a fluid-tight seal between said rod and said piston;

a first adjustable packing gland assembly also disposed in the bore through said piston, said packing gland assembly including a second piston packing means disposed in encircling relation to said rod and adjustable clamping means for selectively energizing and radially expanding said second piston packing means into clamping engagement with said rod;

a second adjustable packing gland assembly disposed in the bore of said housing adjacent one end thereof, said second adjustable packing gland assembly including lower annular packing means disposed in encircling relation to said rod and a second adjustable clamping means for selectively energizing said lower annular packing means to radially expand said lower annular packing means into clamping engagement with said rod;

a bi-directional packing seal means in the bore of said housing in encircling relationship to said rod and establishing a fluid-tight sealing relationship with said rod, said bi-directional packing means being disposed in said housing bore at a location spaced from the upper end of the piston when the piston is in its uppermost position;

means for selectively communicating fluid pressure in said well bore to the bore of said housing at a location above said bi-directional packing means thereby equalizing the pressure on both ends of said rod when the tool is mounted in a wellhead and the lower end of the rod is exposed to the well pressure;

fluid control means to selectively apply fluid pressure to one or the other sides of said piston for moving said piston in either direction between its uppermost and lowermost positions, said rod being movable in a series of steps by said piston in accordance with selective activation of said first and second adjustable clamping means to either lower said plug means into operating position in the wellhead bore or to retract said manipulator rod from the wellhead after installation of said plug means in the wellhead.

8. A tool as described in claim 7 wherein said rod is adapted to be lowered into the wellhead by a series of piston strokes for predetermined location of said plug means, said plug means being installable in said wellhead bore upon axial rotation of said manipulator rod.

9. A tool as described in claim 7 wherein said housing is provided with openings which are sufficiently large that the manipulator rod may be manually gripped for axial rotation to install or remove said plug means or may be lifted for removal from the well bore when said first and second clamping means are in non-clamping condition.

* * * * *